United States Patent [19]

Werner

[11] Patent Number: 5,055,031

[45] Date of Patent: Oct. 8, 1991

[54] FIRE VORTEX DISPLAY

[76] Inventor: John Werner, 11036 Langmuir Ave., Sunland, Calif. 91040

[21] Appl. No.: 519,913

[22] Filed: May 7, 1990

[51] Int. Cl.[5] ..... F23Q 2/32; F23N 3/00

[52] U.S. Cl. ..... 431/726; 431/4; 431/354; 431/350; 431/257

[58] Field of Search ..... 431/126, 4, 9, 125, 431/252, 253, 350, 352, 353, 354

[56] References Cited

U.S. PATENT DOCUMENTS

| | | | |
|---|---|---|---|
| 2,769,366 | 11/1956 | Honma | 431/126 X |
| 2,805,598 | 9/1957 | Sprague et al. | 431/126 X |
| 3,507,589 | 4/1970 | Keller | 431/126 |
| 3,894,833 | 7/1975 | Rinecker | 431/117 |
| 3,991,689 | 11/1976 | Rinecker | 431/117 |
| 4,125,360 | 11/1978 | Culbertson | 431/4 X |
| 4,331,638 | 5/1982 | Michelfelder | 431/4 X |
| 4,784,043 | 11/1988 | Kobayashi et al. | 431/174 |

*Primary Examiner*—Larry Jones

[57] ABSTRACT

A fire vortex display for providing an interesting fire display for decorative and attention getting purposes. The display utilizes a burner for burning a gaseous or liquid fuel, typically in a very fuel rich mixture. The burner is located at one end of a normally vertical transparent tube such as a Pyrex tube, with a blower blowing air into the tube adjacent to the burner in a substantially circumferential manner to provide a swirling action for the flame given off by the burner as the flame proceeds upward into the tube. A second transparent tube concentric with and somewhat larger than the first tube is provided over the first tube, with the region between the two tubes being ducted to form the inlet for the blower. This keeps the outer tube cool so that the fire vortex can be observed from a position close thereto and the outer tube even touched by an observer without danger thereto. Also disclosed are methods of controlling the fire vortex to control the direction and speed of spiraling thereof and the color of the flame.

5 Claims, 1 Drawing Sheet

FIRE VORTEX DISPLAY

BRIEF SUMMARY OF THE INVENTION

A fire vortex display for providing an interesting fire display for decorative and attention getting purposes. The display utilizes a burner for burning a gaseous or liquid fuel, typically in a very fuel rich mixture. The burner is located at one end of a normally vertical transparent tube such as a Pyrex tube, with a blower blowing air into the tube adjacent to the burner in a substantially circumferential manner to provide a swirling action for the flame given off by the burner as the flame proceeds upward into the tube. A second transparent tube concentric with and somewhat larger than the first tube is provided over the first tube, with the region between the two tubes being ducted to form the inlet for the blower. This keeps the outer tube cool so that the fire vortex can be observed from a position close thereto and the outer tube even touched by an observer without danger thereto. Also disclosed are methods of controlling the fire vortex to control the direction and speed of spiraling thereof and the color of the flame.

DETAILED DESCRIPTION OF THE INVENTION

Figure 1:
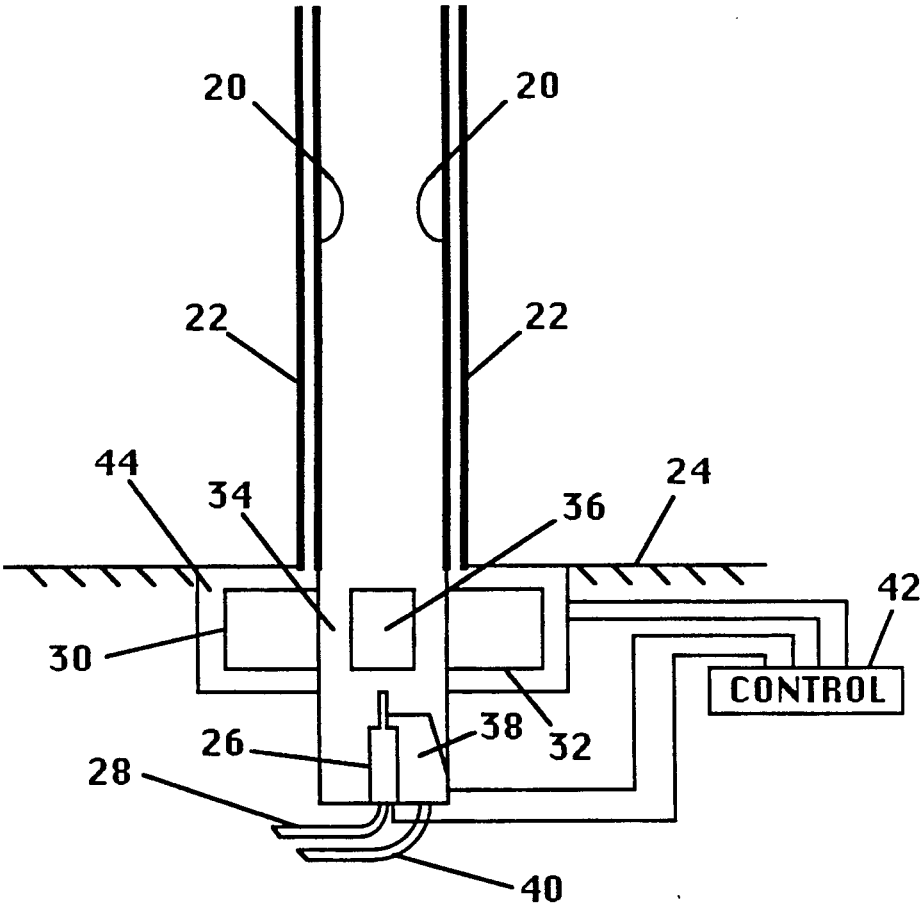
FIG. 1 is a schematic cross section of a preferred embodiment of the fire vortex display of the present invention.

First referring to FIG. 1, a schematic cross section of a preferred embodiment of the present invention may be seen. This Figure illustrates a typical installation of the present invention as it might be used for accent and attention getting purposes in a shopping mall, entertainment center or the like. As shown therein, a pair of concentric tubes 20 and 22 are supported in a vertical orientation with their lower ends substantially flush with floor 24. The tubes 20 and 22 are transparent, or at least substantially transparent, with at least the inner tube 20 being of a material having a relatively high temperature capability, such as by way of example, Pyrex. Preferably the diameter of the inner tube will be approximately one foot, with the annular space between the two tubes being on the order of approximately one inch so as to define an annular air flow passage therebetween. In a typical installation, the tubes 20 and 22 will extend upward to a level above a typical persons reach, with the upper end either being ducted for exhaust purposes, or more preferably having a heat shield at the top thereof or on the ceiling of the structure within which it is used so as to dissipate the heated air and combustion products at the top thereof without any potential danger therefrom. In that regard, in an outside installation one could readily use a hatlike cover at the top of the tubes to provide the required ventilation and, at the same time, keep out rain, foreign objects, and the like.

Mounted within or below the floor 24 is a burner 26 coupled through line 28 to a source of appropriate combustible fuel in either liquid or gaseous form. The burner 26 typically will be adjusted so as to operate on a fuel rich mixture, preferably as fuel rich as possible to still obtain an orderly elongated flame therefrom.

Figure 2:
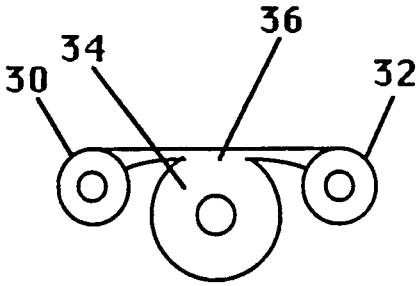
FIG. 2 is a top view of a portion of the apparatus of FIG. 1 illustrating the connection of blowers 30 and 32 with chamber 34.

Mounted at the lower end of tubes 20 and 22 and adjacent burner 26 are blowers 30 and 32, better seen in the partial cross section taken therethrough of FIG. 2. The blowers 30 and 32 are preferably individual electric blowers, typically in the form of fractional horsepower squirrel cage blowers, each exhausting tangentially into the cylindrical region 34 adjacent to burner 26 and the lower ends of the tubes through opening 36 in the chamber 34, the two blowers exhausting into the chamber in different tangential directions (see both FIGS. 1 and 2).

Also schematically shown in FIG. 1 is an injection system 38 for injecting colorants into burner 26 to controllably color the flame given off by the burner. In that regard, various compounds are well known for effecting the color of the flame, allowing one to controllably change the color of the flame gradually and/or relatively quickly as desired by controlling the flow of the colorant. Because such materials and injection systems are well known in various forms in the prior art, details thereof will not be given herein. While such systems are not limited to liquid colorants, liquid colorants are the easiest to handle and may be readily provided through supply line 40 as controlled in any desired varying manner by control system 42. In that regard, control system 42, typically a microcomputer control system, is connected to control blowers 30 and 32 independently (though typically in a coordinated manner), to control the flame coloring apparatus to control the flame colors and variations thereof as well as to turn the same on and off, and to similarly turn burner 26 on and off as desired. In that regard, the preferred embodiment of the present invention is of a scale which consumes fuel at a relatively high rate, and accordingly is most economically used periodically for accent purposes, as opposed to continuously or semi continuously.

In operation, the controller 42 typically will be programmed to periodically turn on burner 26 and to cycle the flame color system 38 through the various available colors in the system. At the same time, controller 42 will control blowers 30 and 32 so as to create a swirling action in the flame within tube 20, with the swirling direction and rate being controllable and thus variable as desired through the control of the blowers 30 and 32. In particular, with one of the blowers off, or nearly off, and the other blower operating at full speed, the approximate rodlike flame of the burner 36 is swept into an undulating vortex of a first rotational direction. Decreasing the blower speed will reduce the rate or rotation of the vortex, with the rate being reducible to zero and reversible by increasing the speed of the opposite blower, as the first blower speed is reduced to zero or to a quiescent level. As may be seen in FIG. 1, blowers 30 and 32, and more specifically the inlets therefor, are located within plenum 44 in communication with the annular region between tubes 20 and 22. Thus, the blowers maintain a constant flow of air downward through the annular space between the two tubes to cool the outer tube 22, typically so that it is no more than merely warm to the touch. For this purpose it is preferable to always have at least one blower operating at some minimum level, except for short durations, if the display is to be located where the same may be touched by an observer. Obviously, of course, if the duration of operation of the fire vortex display is to be sufficiently short, excessive heating of the tube 22 may be prevented just by sufficiently limiting the duration of each operation of the system and the duty cycle thereof.

There has been disclosed and described herein a new and unique fire vortex system which may be used to provide an interesting attraction and accent in installations even where the casual observer may inadvertently or even intentionally come into contact therewith. While the present invention has been disclosed and described herein with respect to a preferred embodiment thereof, it will be understood by those skilled in the art that various changes in form and detail may be made therein without departing from the spirit and scope thereof.

I claim:

1. A fire display comprising:

a burner for coupling to a source of combustible gas or liquid for burning the same and emitting a flame in response thereto;

a first transparent tube disposed with one end thereof adjacent said burner;

a second transparent tube larger than and substantially concentric with said first transparent tube so as to define an annular space therebetween;

a first blower having a blower inlet and a blower outlet, said blower inlet being coupled to said annular space between said first and second transparent tubes adjacent one end thereof and said blower outlet being coupled to inject air adjacent to said burner with a substantial circumferential flow so as to cause a swirling motion of a flame emitted from the burner in a first direction of rotation as the same proceeds along said first transparent tube;

the airflow between said first and second transparent tubes caused by said blower cooling said second transparent tube.

2. The fire display of claim 1 wherein said burner is a means for burning a combustible liquid or gas with a fuel rich mixture.

3. The fire display of claim 1 further comprised of;

a second blower also having a blower inlet and a blower outlet, the inlet of said second blower being coupled to said annular space between said first and second transparent tubes adjacent the same end thereof as said inlet of said first blower, and said outlet of second blower being coupled to inject air adjacent to said burner with a substantial circumferential flow so as to cause a swirling motion of a flame emitted from the burner in a second direction of rotation opposite said first direction of rotation as the same proceeds along said first transparent tube; and control means for controlling said blowers so as to control the direction and rate of swirling of the flame as the same proceeds along said first transparent tube.

4. The fire display of claim 3 further comprised of means for injection of a colorant to alter the color of the flame of said burner.

5. The fire display of claim 4 wherein said control means is also a means for controlling said means for injection of a colorant to alter the color of the flame of said burner.

* * * * *

UNITED STATES PATENT AND TRADEMARK OFFICE

CERTIFICATE OF CORRECTION

PATENT NO. : 5,055,031

DATED : 10/8/91

INVENTOR(S) : Werner

It is certified that error appears in the above-identified patent and that said Letters Patent is hereby corrected as shown below:

ON TITLE PAGE: insert --[73] Assignee: Wet Design, Universal City, California--

Signed and Sealed this

Twelfth Day of May, 1992

*Attest:*

DOUGLAS B. COMER

*Attesting Officer*

*Acting Commissioner of Patents and Trademarks*